US005987690A

United States Patent [19]

Heuler

[11] Patent Number: 5,987,690

[45] Date of Patent: Nov. 23, 1999

[54] RESILIENT TOOTHBRUSH

[76] Inventor: Uwe Heuler, Karlstrasse 54, D-79104 Frieburg, Germany

[21] Appl. No.: 08/973,141

[22] PCT Filed: May 29, 1996

[86] PCT No.: PCT/DE96/00973

§ 371 Date: Feb. 27, 1998

§ 102(e) Date: Feb. 27, 1998

[87] PCT Pub. No.: WO96/38067

PCT Pub. Date: Dec. 5, 1996

[30] Foreign Application Priority Data

May 30, 1995 [DE] Germany ..... 195 19 674

[51] Int. Cl.[6] ..... A46B 9/04

[52] U.S. Cl. ..... 15/167.1; 15/172

[58] Field of Search ..... 15/167.1, 172, 15/201

[56] References Cited

U.S. PATENT DOCUMENTS

| | | | |
|---|---|---|---|
| 1,132,326 | 3/1915 | Fouyer | 15/167.1 |
| 1,739,324 | 12/1929 | Neissl | 15/167.1 |
| 2,273,207 | 2/1942 | Kuhn | 15/167.1 |
| 4,520,526 | 6/1985 | Peters | 15/201 |
| 5,054,154 | 10/1991 | Schiffer | 15/172 |
| 5,105,499 | 4/1992 | Dirksing . | |
| 5,272,784 | 12/1993 | Levin | 15/167.1 |

FOREIGN PATENT DOCUMENTS

| | | |
|---|---|---|
| 0573514 | 9/1992 | European Pat. Off. . |
| 813148 | 9/1951 | Germany . |
| 0 339 350 | 11/1989 | Germany . |
| 0 371 293 | 6/1990 | Germany . |
| 195 19 674 C1 | 5/1995 | Germany . |
| WO/21152 94 | 9/1994 | WIPO . |

*Primary Examiner*—Randall E. Chin

*Attorney, Agent, or Firm*—Gary M. Nath; Harold L. Novick; Nath & Associates

[57] ABSTRACT

The invention concerns a toothbrush comprising a handle and a brush head, which is equipped on one side with clusters of bristles, a resilient connection being provided between the handle and the brush head. When pressure is exerted on the surface formed by the free ends of the clusters of bristles, the connection allows the brush head to be deflected relative to the handle. This is achieved in that the connection is formed by a hinged rectangle whose axes of rotation extend transversely to the longitudinal extension of the handle and the bristles, and in that the distance between the two hinges closest to the brush head is less than or equal to the distance between the two hinges closest to the handle.

6 Claims, 2 Drawing Sheets

RESILIENT TOOTHBRUSH

FIELD OF INVENTION

The invention concerns a toothbrush with a bristle carrier equipped with bristle bundles on one side, with a handle, and with an elastic connection between the handle and the bristle carrier, which makes possible a deflection of the bristle carrier with respect to the handle when pressure is exerted on the surface formed by the free ends of the bristle bundles.

BACKGROUND OF INVENTION

The toothbrush is still the essential and most reliable aid for indispensable dental hygiene. When using a brush to clean teeth, however, pressure is always exerted on the teeth with the bristles and thus unavoidably also on the gums. This pressure is measured out only with difficulty by human sensation and the hand, so that on one hand, a sufficient cleaning of the teeth and their gaps is brought about, and on the other hand, the gums are not injured by excessively high pressure.

Toothbrushes available on the market, with an elastic brush head and as described, for example, in European Patent No. 0,371,293 A2, do not provide any remedy here since they are constructed in such a manner that the bristle head gives way with the pressure exerted, but the bristle surface is inclined away from the bristle head. This means that when pressure is exerted on the bristle head, the one-sided bristles are inclined away from the cleaning surface, but via the bristles on the side of the handle, the same unreduced pressure is exerted on a substantially smaller bristle surface. These toothbrushes are therefore not to be considered as an improvement but rather are to be evaluated as disadvantageous, since the risk of injury to the gums is not reduced, but rather is even increased by a smaller effective area of the bristle tips.

European Patent No. 0,339,350 A1 describes a toothbrush whose brush head can be moved by a two-part handle, consisting of an upper part and a lower part, in such a way that the surface of the brush head can assume various angles with respect to the handle. The disadvantage of this brush consists in the fact that the inclination must by adjusted by the hand and there is no way of avoiding that either the bristles close to the handle or those of the tip of the brush are pressed more on the teeth and that therefore, there is no uniform pressure distribution over the entire bristle surface. Furthermore, a considerable application of force by the hand, which cannot be controlled and measured out for the desirable purpose, is required to change the angle of inclination.

SUMMARY OF THE INVENTION

The goal of the invention is, therefore, the construction of a toothbrush, which has an elastic bristle head, in such a manner that upon deflection of the brush head, the surface formed by the free bristle ends of the bristle bundle is not inclined away from the handle, but rather retains the parallel alignment with respect to the handle or inclines against the handle, so that it is always ensured that the full cleaning effect of the entire bristle surface is used and no pressure peaks with respect to the gums appear.

The goal is thereby attained in that the connection is formed by a four-bar linkage, whose turning axes run transverse to the longitudinal extension of the handle and the bristles, and that the distance between the two links, facing the bristle carrier, from one another is smaller or the same as the distance between the two links, facing the handle, from one another.

BRIEF DESCRIPTION OF THE DRAWINGS

The construction of the toothbrush in accordance with the invention is illustrated, by way of example, in the figures. The individual figures show the following.

Figure 1:
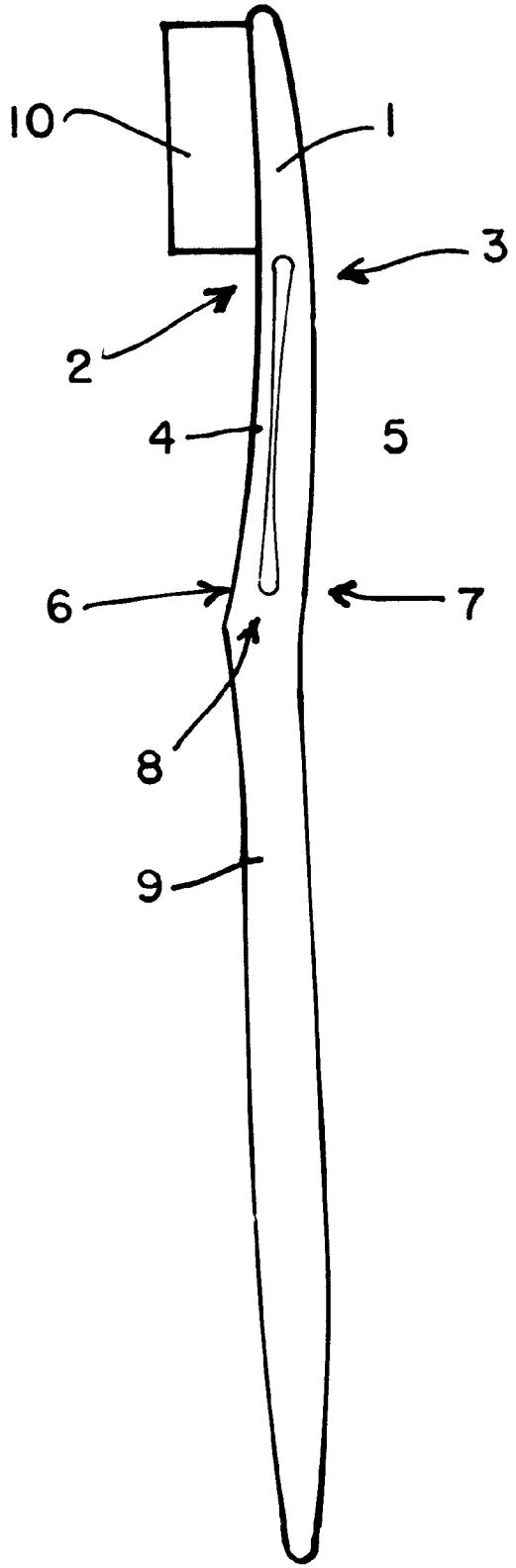
FIG. 1, a preferred shape of the toothbrush in a side view, in which a two-side rod connection is present between the handle and the brush head.
Figure 2:
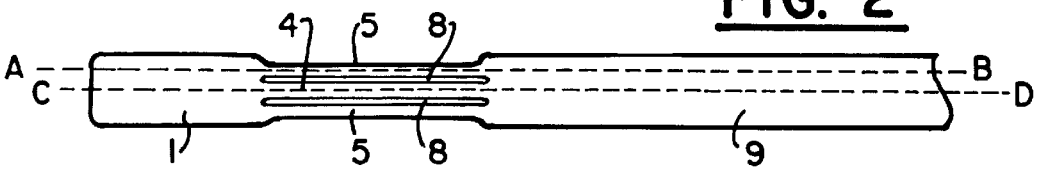
FIG. 2 shows a preferred shape of the toothbrush in top view, in which a three-tie rod connection is present between the handle and the brush head.
Figure 3:
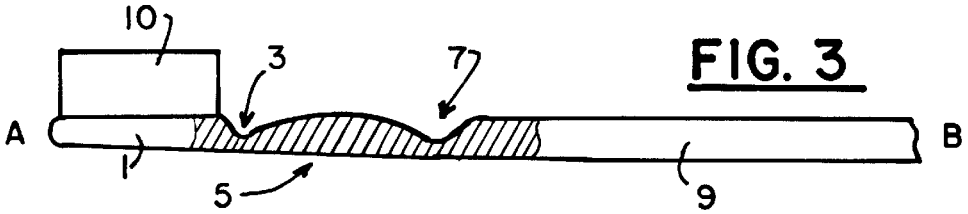
FIG. 3 shows a sectional drawing of the toothbrush in accordance with FIG. 2 along the intersecting line A–B in a side view.
Figure 4:
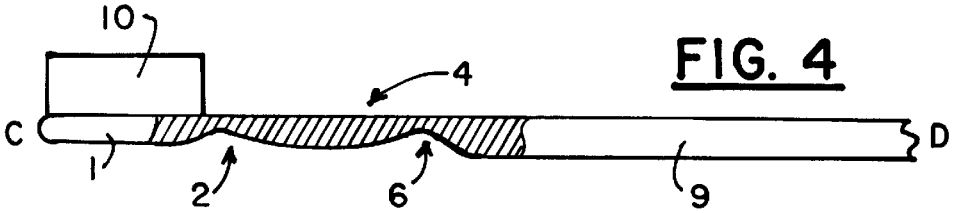
FIG. 4 shows a sectional drawing of the toothbrush in accordance with FIG. 2 along the intersecting line C–D in a side view.

The reference symbols given in the figures have the following meaning:

1 Bristle carrier
2 Link
3 Link
4 Diagonal tie rod
5 Slide tie rod
6 Link
7 Link
8 Slot
9 Handle
10 Bristles

DETAILED DESCRIPTION

The invention concerns a toothbrush with a bristle carrier (1), connected elastically with the handle (9), with bristle bundles (10) arranged therein on one side, which can be moved by exerting pressure on the surface of the bristle bundle (10) in such a way that the surface of the bristle bundle (10) always runs parallel to the handle (9) or is inclined against it.

This is attained by a multiple-tie rod, preferably 2- or 3-tie rod connection between the handle (9) and bristle carrier (1), wherein the connecting sites of the tie rods (4,5), with the handle (9) or the bristle carrier (1), have the function of links (2,3,6,7). Diagonal tie rods (4) and slide tie rods (5) are preferably tapered at these points to increase the elastic link effect. An elastic effect can, however, also be attained by using a more elastic material in the area of the connecting points.

Figure 5:
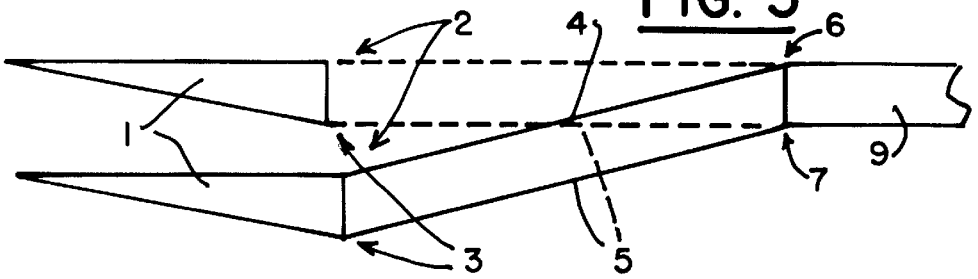
FIG. 5 describes the mode of functioning of a toothbrush in accordance with FIG. 1 with two tie rods, which are arranged in trapezoidal form with respect to one another, that is, on the handle part, having a greater distance from one another than at the brush head.

In a preferred specific embodiment, the toothbrush, in accordance with FIG. 1, has a diagonal tie rod (4) and a slide tie rod (5), in which the individual distances between the links (2) and (3) and (6) and (7) are the same. Upon exerting pressure on the bristle bundle (10), the surface of the bristle bundle (10) is displaced parallel to the handle (9), as shown in FIG. 5.

Figure 6:
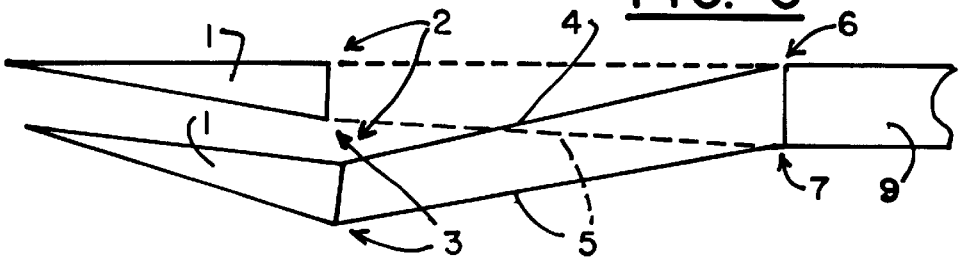
FIG. 6 describes the mode of functioning of a toothbrush in accordance with FIG. 1 with two tie rods, which are arranged in trapezoidal form with respect to one another, that is, on the handle part, having a greater distance from one another than at the brush head.

If the toothbrush according to FIG. 1 is designed in such a way that the handle (9) is constructed thicker, in comparison to the bristle carrier (1), than the distance between the links (6) and (7) is larger than that between (2) and (3). Pressure on the bristle surface then leads to an elastic movement in such a way that the bristle surface is inclined toward the handle (9), as is shown schematically in FIG. 6.

What is claimed is:

1. Toothbrush with a bristle carrier (1) having a first side and a second side, the bristle carrier being equipped with bristle bundles (10) having free ends and bound ends bound on the first side, with a handle (9), and with an elastic connection between the handle (9) and the bristle carrier (1), the elastic connection capable of allowing a deflection of the bristle carrier (1) with respect to the handle (9) when pressure is exerted on the surface formed by the free ends of the bristle bundles (10), characterized in that the connection is formed by a four-bar linkage (2,3,6,7), whose turning axes run transverse to a longitudinal extension of the handle (9), and the bristles (10), and that the distance of the two links (2,3) facing the bristle carrier from one another is smaller than the distance of the two links (6,7), facing the handle (9), from one another characterized in that the connection formed by the four-bar linkage (2,3,6,7) has three tie rods between the handle (9) and the bristle carrier (1).

2. Toothbrush according to claim 1 characterized in that the elastic connection produces an elastic effect which is brought about by a tapering of the tie rods (4,5) on the links (2,3,6,7).

3. Toothbrush according to claim 1 characterized in that the elastic connection produces an elastic effect which is brought about by using a more flexible material on the links (2,3,6,7).

4. Toothbrush with a bristle carrier (1) having a first side and a second side, the bristle carrier being equipped with bristle bundles (10) having free ends and bound ends bound on the first side, with a handle (9), and with an elastic connection between the handle (9) and the bristle carrier (1), the elastic connection capable of allowing a deflection of the bristle carrier (1) with respect to the handle (9) when pressure is exerted on the surface formed by the free ends of the bristle bundles (10), characterized in that the connection is formed by a four-bar linkage (2,3,6,7), whose turning axes run transverse to a longitudinal extension of the handle (9), and the bristles (10), and that the distance of the two links (2,3) facing the bristle carrier from one another is the same as the distance of the two links (6,7), facing the handle (9), from one another characterized in that the connection formed by the four-bar linkage (2,3,6,7) has three tie rods between the handle (9) and the bristle carrier (1).

5. Toothbrush according to claim 4 characterized in that the elastic connection produces an elastic effect which is brought about by a tapering of the tie rods (4,5) on the links (2,3,6,7).

6. Toothbrush according to claim 4 characterized in that the elastic connection produces an elastic effect which is brought about by using a more flexible material on the links (2,3,6,7).

* * * * *